US008061982B2

(12) United States Patent
Twell

(10) Patent No.: US 8,061,982 B2
(45) Date of Patent: Nov. 22, 2011

(54) FLUID INTAKE ASSEMBLY

(75) Inventor: Philip Twell, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/668,891

(22) PCT Filed: Mar. 18, 2009

(86) PCT No.: PCT/EP2009/053202

§ 371 (c)(1),
(2), (4) Date: Jan. 13, 2010

(87) PCT Pub. No.: WO2009/135721

PCT Pub. Date: Nov. 12, 2009

(65) Prior Publication Data

US 2011/0038722 A1 Feb. 17, 2011

(30) Foreign Application Priority Data

May 7, 2008 (EP) ..... 08008607

(51) Int. Cl.
*F01D 25/24* (2006.01)

(52) U.S. Cl. ..... 415/197; 415/200

(58) Field of Classification Search ..... 415/200, 415/232, 196, 197
See application file for complete search history.

(56) References Cited

U.S. PATENT DOCUMENTS

| | | | | |
|---|---|---|---|---|
| 5,259,724 | A | 11/1993 | Liston et al. | |
| 7,520,717 | B2 * | 4/2009 | Kindl et al. | 415/159 |
| 2004/0045766 | A1 | 3/2004 | Porte et al. | |

FOREIGN PATENT DOCUMENTS

| | | | |
|---|---|---|---|
| GB | 2273131 | A | 6/1994 |
| JP | 06307250 | A * | 11/1994 |
| WO | WO 2008006961 | A1 | 1/2008 |

OTHER PUBLICATIONS

JP 06307250 A Machine Translation. Accessed JPO website Mar. 7, 2011.*

* cited by examiner

*Primary Examiner* — Richard Edgar

(57) ABSTRACT

A fluid intake assembly adapted for use with a turbo-machine is provided. The fluid intake assembly provides an efficient fluid inlet assembly including a casing adapted to guide fluid into the turbo-machine. The casing includes an inner wall, the inner wall having a lining of a resin infused composite material. A method of producing a fluid intake assembly for use with a turbo-machine is also provided.

17 Claims, 3 Drawing Sheets

FLUID INTAKE ASSEMBLY

CROSS REFERENCE TO RELATED APPLICATIONS

This application is the US National Stage of International Application No. PCT/EP2009/053202, filed Mar. 18, 2009 and claims the benefit thereof. The International Application claims the benefits of European Patent Office application No. 08008607.7 EP filed May 7, 2008, both of the applications are incorporated by reference herein in their entirety.

FIELD OF INVENTION

The present invention relates to a fluid intake assembly adapted for use with a turbo-machine.

BACKGROUND OF INVENTION

The inlet casing for an industrial turbo-machine may be required to serve two functions which can be to guide fluid into the turbo-machine and to support the rotor bearings. The common material chosen for this casing is sand cast SG-Iron (SG: spheroidal graphite) which combines the feature of required low temperature ductility with relatively low cost. The draw back of this material and production method is high surface roughness and poor tolerance control especially in the fluid washed area. These causes high scrap and rework costs and potential performance loss.

"SG-Iron" is an abbreviation for Spheroidal Graphite Cast Iron. As the name implies, graphite is present in spheroidal form instead of flakes and compared with Grey Cast Iron it has higher mechanical strength, ductility and increased shock resistance.

SUMMARY OF INVENTION

The object of the present invention is to provide an improved fluid intake assembly for a turbo-machine.

This object is achieved by a fluid intake assembly adapted for use with a turbo-machine, particularly a gas turbine, comprising:

a casing adapted to guide fluid into the turbo-machine, said casing comprising an inner wall, the inner wall having a lining of a resin infused composite material.

More specifically, the turbo-machine may be a gas turbine, the casing may guide fluid into a compressor of the turbo-machine, and the casing material may be spheroidal graphite iron.

This object is achieved by providing a method of producing a fluid intake assembly for use with a turbo-machine, particularly a gas turbine, comprising the steps of:

providing a casing of the fluid intake assembly as a first mould; providing a temporary structure inline with an inner wall of the casing which acts as a second mould wherein the first mould and the second mould form a mould cavity between the inner wall and the second mould;

providing a composite material in the mould cavity;

infusing a resin in the composite material, and removing the second mould when the resin is cured to produce a lining of the resin infused composite material on the inner wall of the casing.

As before, the casing may particularly be adapted to guide fluid into a compressor of the turbo-machine and the casing material may be spheroidal graphite iron.

The underlying idea of the invention is to provide a lining for the inlet casing of a turbo-machine with a composite material by an infusion process directly onto said casing. This inlet casing with the lining results in a consistent fluid passage with good tolerance control and enables to provide less surface roughness and high corrosion protection.

In preferred embodiments of the invention, the composite material is glass fibre or glass strand matting. This results in a lining having inherent corrosion protection and in enhancing the cast tolerances to reduce initial casting scrap and rework.

In a further embodiment, the casing includes at least one strut. The struts also suffer from shape and surface defects. Since struts form the part of the casing the lining of the composite material needs to extend to the struts covering the cast surface of the struts.

In a further embodiment, the lining comprises a smooth surface. This feature facilitates smooth flow of fluid through the inlet casing into the turbo-machine reducing uneven fluid flow distribution resulting in higher performance.

In a further embodiment, the fluid is a gas, the turbo-machine is a gas turbine and the casing is adapted to guide the gas into a compressor of the turbo-machine. The casing here enables the smooth flow of the gas to the compressor without any turbulence or disturbance.

In another embodiment of the invention, the resin is polyester. This facilitates the inlet casing to be cost effective.

BRIEF DESCRIPTION OF THE DRAWINGS

In an alternative embodiment of the invention, the resin is phenolic resin. This facilitates the inlet casing to be operated at high temperatures as phenolic resin is fire resistant.

The present invention is further described hereinafter with reference to preferred embodiments shown in the accompanying drawings, in which.

DETAILED DESCRIPTION OF INVENTION

The fluid intake assembly adapted for use with a turbo-machine according to the invention preferably is a gas intake assembly adapted for use with a gas turbine. Therefore the invention henceforth is described with respect to this preferred embodiment. However the fluid intake assembly could also be a steam intake assembly adapted for use with a steam turbine or any other fluid intake assembly for various turbo-machine types.

Figure 1:
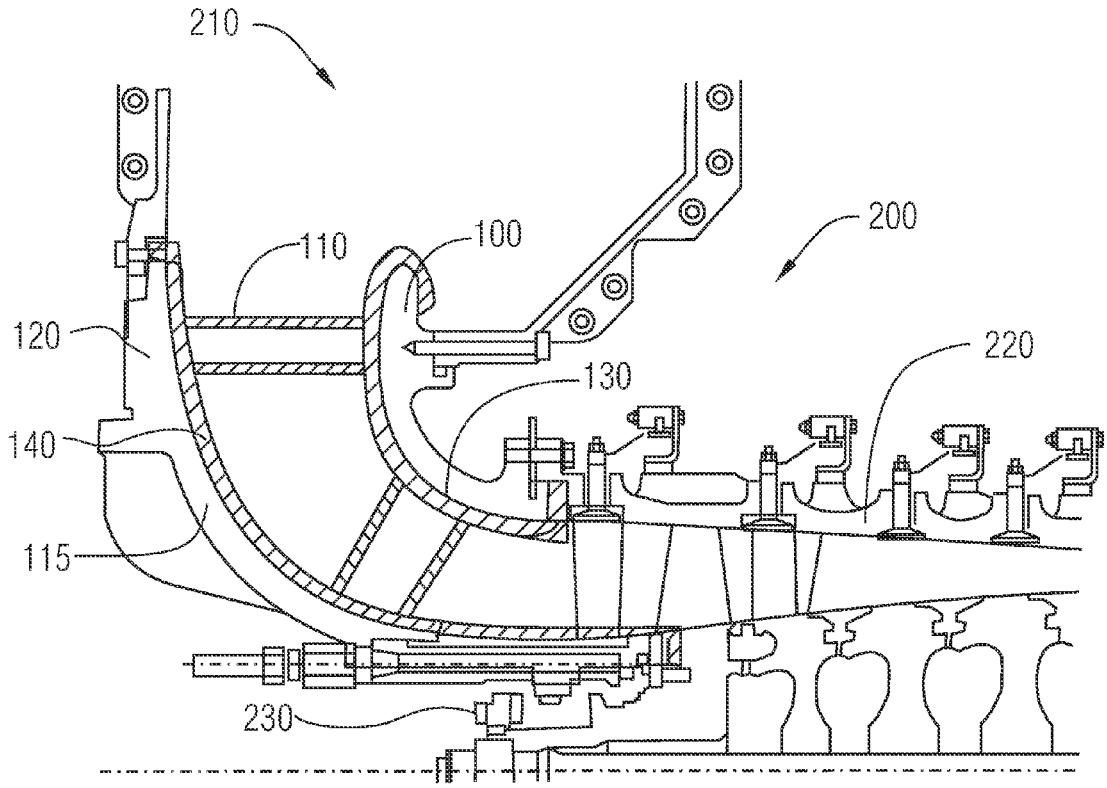
FIG. 1 shows the side view of a gas intake assembly connected to a compressor of a typical industrial gas turbine.

FIG. 1 shows a gas intake assembly 100 incorporated into a typical industrial gas turbine 200. The gas turbine 200 is shown to have the gas intake assembly 100 arranged with an air inlet duct 210 at one end and a compressor 220 at the other end. The gas intake assembly 100 helps to guide gas into the compressor 220 and also helps in supporting the rotor bearings 230. The gas intake assembly 100 comprises a casing 120 which comprises of the side casing 115 along with plurality of struts 110. The lining 140 given in the inner wall 130 of casing 120 of the gas intake assembly 100 forms a consistent gas passage with good tolerance control.

Figure 2:
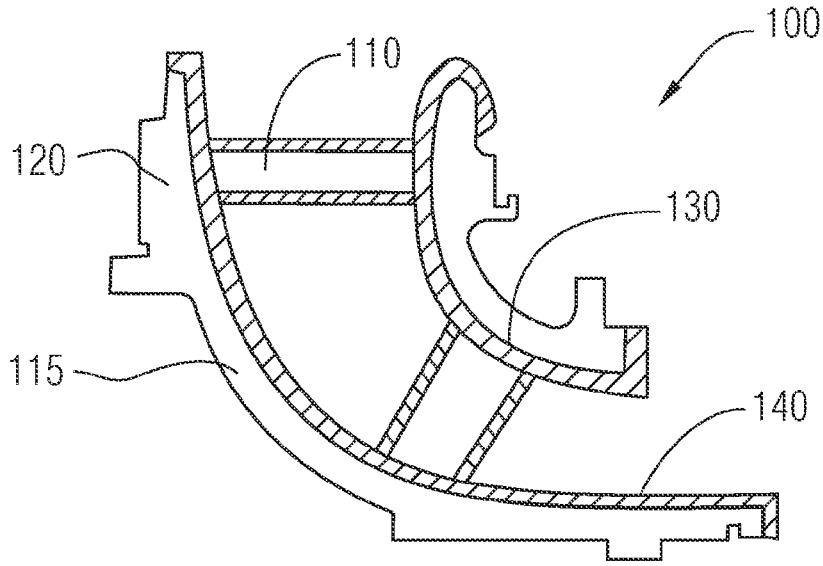
FIG. 2 shows side view of the gas intake assembly adapted for use with a gas turbine.

FIG. 2 shows the gas intake assembly 100 adapted for use with a gas turbine. The assembly comprising of a casing 120 adapted to guide gas into a compressor 220 shown in FIG. 1.

The casing 120 comprises the side casing 115 along with the plurality of struts 110. The casing 120 comprising an inner wall 130, where the inner wall 130 is given a lining 140 of a resin infused composite material. The lining 140 comprises a smooth surface, where in operation is adapted to enabling a smooth flow of the gas into the compressor 220. The thickness of the lining 140 need to be greater than the casting shape deviation to fill the negative voids but not to leave thin sections above the positive bumps. The extent of the lining 140 depends on the area that requires correction for shape deviation but preferably this might extend for the complete gas wash surface.

Figure 3:
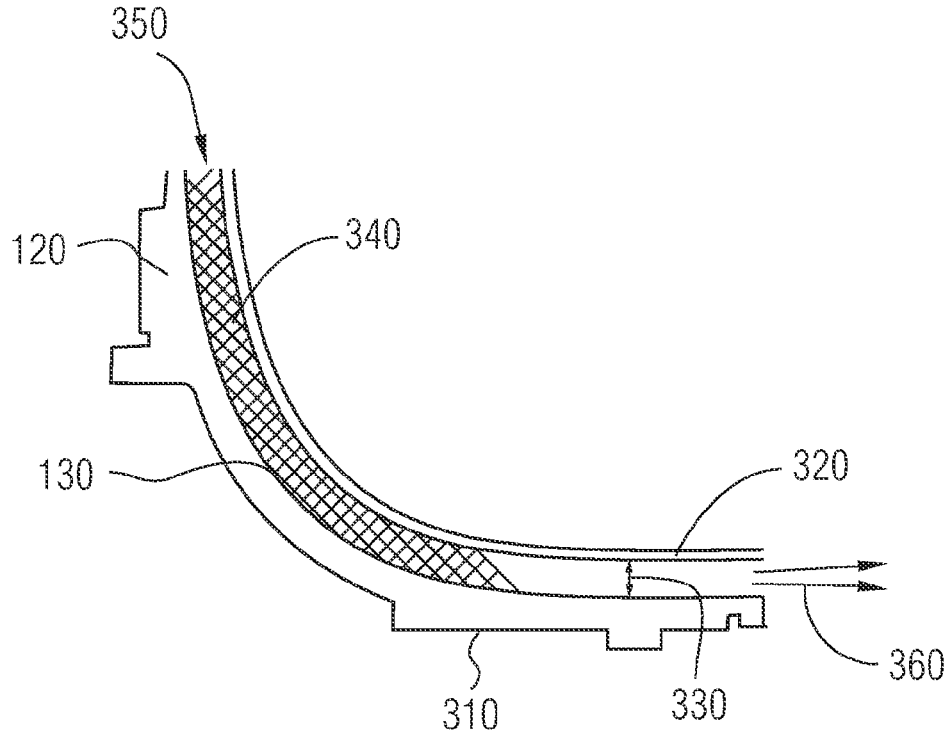
FIG. 3 shows a portion of the gas intake assembly subjected to closed mould resin infusion process.

FIG. 3 shows a portion of the gas intake assembly 100 subjected to closed mould resin infusion process. The method involves providing the casing 120 of the gas intake assembly 100 as a first mould 310. A temporary structure is provided inline with an inner wall 130 of the casing which acts as a second mould 320. The first mould 310 and the second mould 320 form a mould cavity 330 between them. Then a composite material 340 is provided in the mould cavity 330. The composite material used might be a glass strand matting or glass fibre. Later a resin 350 is infused in the composite material 340 resulting in a resin infused composite material. The resin used might be a polyester resin or phenolic resin. Other resins may be used if specific application demands. Finally the second mould 320 is removed when the resin is cured to produce a lining 140 as shown in FIG. 1.

One of the preferred ways of infusion is the vacuum infusion which greatly improves the fibre-to-resin ratio, and results in a stronger and lighter product. Vacuum infusion provides a number of improvements including better fibre-to-resin ratio, less wasted resin, very consistent resin usage, unlimited set-up time and cleaner process. This lowers weight, increases strength, and maximizes the properties of fibre and resin consistency.

Resin usage will be predictably similar upon repeated attempts. This results in less wasted resin, and more importantly, less wasted money. Choosing reinforcement is an important decision, but there are additional considerations when choosing one for infusion. The glass fibre or a glass strand matting is the most frequently used reinforcement in vacuum infusion. Most fibre glass fabrics offer high permeability, allowing resin to easily flow through.

In the infusion process resin is infused using vacuum pressure 360. Resin 350 will always travel in the path of least resistance. Resin choice is another key aspect of vacuum infusion process. Any resin can actually be used for infusion, though there are some general guidelines that should be considered when making a decision. One important piece of information that should be examined is the resin viscosity. Typically, lower viscosity will aid infusion, as it allows easier permeation of the reinforcement.

Once everything is in place and ready to go, mix up the resin. By the help of the vacuum pressure 360, resin is quickly sucked through the mould gap 330 where the reinforcing material 340 is filled and expands outward into the reinforcement 340. The rate of infusion depends upon many variables, but the resin should be visibly moving. Allow this to continue until the entire reinforcement is saturated.

Figure 4:
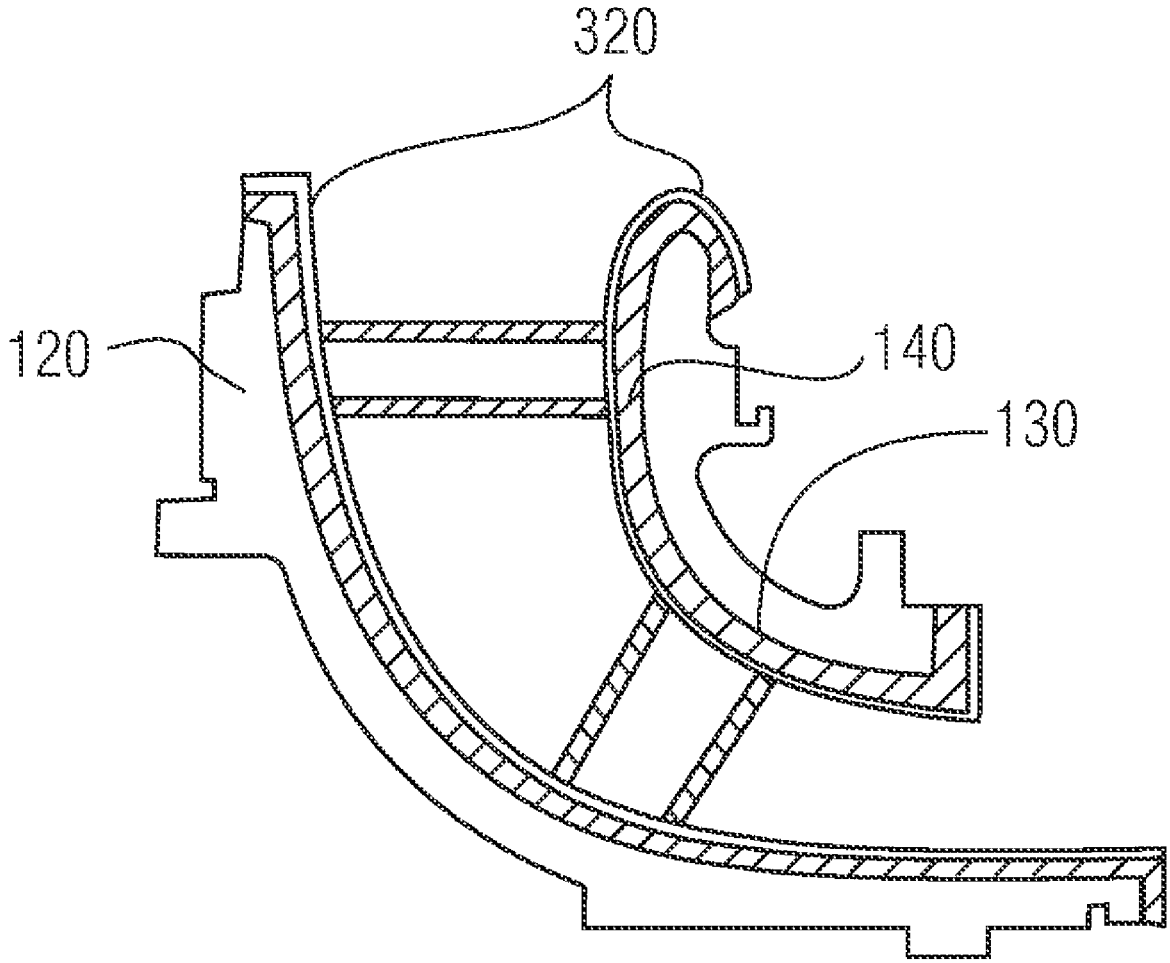
FIG. 4 shows the side view of the gas intake assembly prior to removing the temporary structure.

FIG. 4 shows the side view of the composite lined inlet casing with the temporary structure 320. The inner wall 130 of the casing 120 is provided with a lining 140. The temporary structure 320 which acts as the second mould during infusion process is also shown here which would be removed once the resin passed into the composite material gets cured.

Summarizing, the invention relates to a fluid intake assembly 100 adapted for use with a turbo-machine 200. The invention provides an efficient fluid inlet assembly 100 comprising a casing 120 adapted to guide fluid into the turbo-machine 200. The casing 120 comprises an inner wall 130, the inner wall 130 having a lining 140 of a resin infused composite material. The invention also provides a method of producing a fluid intake assembly 100 for use with a turbo-machine 200. The inlet casing with the lining results in a consistent gas passage with good tolerance control and low surface roughness.

The lining is used on a heavy non precision cast part—the latter may be based on spheroidal graphite cast iron—to give it its final dimension. Using spheroidal graphite cast iron may be advantageous due to a required low temperature ductility with relatively low costs. As a potential draw back, this material and its production methods is poor surface roughness and tolerance control, especially in gas washed areas. This may be overcome by the lining.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

The invention claimed is:

1. A fluid intake assembly used with a turbo-machine, comprising:

a casing that guides a fluid into a compressor of the turbo-machine, wherein a casing material is spheroidal graphite iron, and wherein the casing comprises an inner wall, the inner wall including a lining of a resin infused composite material, and wherein the lining is created by an infusion process directly onto the inner wall of the casing.

2. The fluid intake assembly as claimed in claim 1, wherein the turbo-machine is a gas turbine.

3. The fluid intake assembly as claimed in claim 1, wherein the turbo-machine is a steam turbine.

4. The fluid intake assembly as claimed in claim 1, wherein the resin infused composite material is glass fibre.

5. The fluid intake assembly as claimed in claim 1, wherein the resin infused composite material is glass strand matting.

6. The fluid intake assembly as claimed in claim 1, wherein the casing includes a strut.

7. The fluid intake assembly as claimed in claim 1, wherein the fluid is a gas for a gas turbine.

8. The fluid intake assembly as claimed in claim 1, wherein the fluid is steam for a steam turbine.

9. A method of producing a fluid intake assembly for use with a turbo-machine, comprising:

providing a casing of the fluid intake assembly as a first mould, the casing guides a fluid into a compressor of the turbo-machine;

providing a temporary structure inline with an inner wall of the casing which acts as a second mould, wherein the first mould and the second mould form a mould cavity between the inner wall and the second mould;

providing a composite material in the mould cavity;

infusing a resin in the composite material; and removing the second mould when the resin is cured to produce a lining of the resin infused composite material on the inner wall of the casing, wherein a casing material is spheroidal graphite iron.

10. The method as claimed in claim 9, wherein the turbomachine is a gas turbine.

11. The method as claimed in claim 9, wherein the turbomachine is a steam turbine.

12. The method as claimed in claim 9, wherein the composite material is glass fibre.

13. The method as claimed in claim 9, wherein the composite material is glass strand matting.

14. The method as claimed in claim 9, wherein the resin is polyester.

15. The method as claimed in claim 9, wherein the resin is phenolic resin.

16. The method as claimed in claim 9, wherein the infusing is performed using vacuum infusion.

17. The method as claimed in claim 9, wherein the casing includes a strut.

* * * * *